United States Patent [19]

Petersen et al.

[11] Patent Number: 4,489,015

[45] Date of Patent: Dec. 18, 1984

[54] HUMIDIFIER PAD SUPPORT

[75] Inventors: Kurt E. Petersen; Thomas E. Squires; Charles G. Shepherd, all of Oakville, Canada

[73] Assignee: B. D. Wait Co. Limited, Oakville, Canada

[21] Appl. No.: 484,064

[22] Filed: Apr. 11, 1983

[30] Foreign Application Priority Data

Apr. 13, 1982 [CA] Canada ..... 400869

[51] Int. Cl.[3] ..... B01F 3/04

[52] U.S. Cl. ..... 261/92; 126/113; 248/604; 261/DIG. 15; 261/DIG. 41

[58] Field of Search ..... 261/92, DIG. 15, DIG. 41, 261/DIG. 72; 126/113; 264/146; 428/36, 136; 55/400, 492, 498, 510, 529, 231, 232, 234; 248/603, 604

[56] References Cited

U.S. PATENT DOCUMENTS

| | | | |
|---|---|---|---|
| 3,274,992 | 9/1966 | Martin | 261/92 X |
| 3,599,942 | 8/1971 | Herr | 261/92 |
| 3,640,515 | 2/1972 | Stiles | 55/234 X |
| 3,659,581 | 5/1972 | Geisler et al. | 261/92 X |
| 3,724,824 | 4/1973 | Mitich | 261/92 |
| 3,895,083 | 7/1975 | Yeagle | 55/492 X |
| 4,056,582 | 11/1977 | Chow | 261/92 X |

*Primary Examiner*—Richard L. Chiesa

[57] ABSTRACT

This invention provides a support for a tubular humidifier pad such that the pad can be replaced easily and efficiently. This is achieved by providing a support having a movable end which can be collapsed to release the pad which is carried on axial stringers attached to this end. The stingers deflect radially inwards so that the old pad can be removed over the collapsed end and a new one put in place. The procedure is then reversed to hold the pad on the support.

9 Claims, 9 Drawing Figures

HUMIDIFIER PAD SUPPORT

This invention relates to a support for a tubular humidifier pad of the type used in a humidifier receiving air from a forced air furnace, and more particularly to a support capable of being collapsed to permit ready replacement of the humidifier pad.

Humidifiers are commonly used in association with forced air heating systems to ensure that the heated air maintains an acceptable relative humidity. One type of humidifier which is very often used is attached between the hot or output duct from the furnace and the return air duct. The differential pressures between these ducts causes air to flow through the humidifier where it picks up moisture off a rotating tubular pad. This pad runs with a lower part in a water reservoir to wet the pad. The humidifier is often controlled by a suitably placed humidistat so that the pad moves only when there is a demand to add moisture to the air. This invention is concerned with a support for the tubular pad.

The pad must be cleaned or replaced periodically because the continuous evaporation off the pad causes a calcium-based deposit which eventually renders the pad useless. Conventionally, the pad is carried either on a fixed frame made up from stout wire and sheet metal, or more recently on moulded end pieces which carry axial fingers for engaging the inner surface of the tubular pad. Such prior art supports suffer from several disadvantages of which the major one is the difficulty encountered when replacing a pad. Firstly the pad tends to be locked onto the support by the deposits, and then when the new pad is to be assembled on the support, the pad does not fit easily over the support. This latter problem is emphasized by the fact that the pad must be a snug fit and pads are inherently difficult to make to a close tolerance. Consequently their diameters vary significantly.

Accordingly, it is an object of the present invention to provide a support for a tubular humidifier pad such that the pad can be replaced easily and efficiently. This is achieved by providing a support having a movable end which can be collapsed to release the pad which is carried on axial stringers attached to this end. The stringers deflect radially inwards so that the old pad can be removed over the collapsed end and a new one put in place. The procedure is then reversed to hold the pad on the support.

The invention will be better understood with reference to the following description taken in combination with the drawings, in which.

Figure 1:
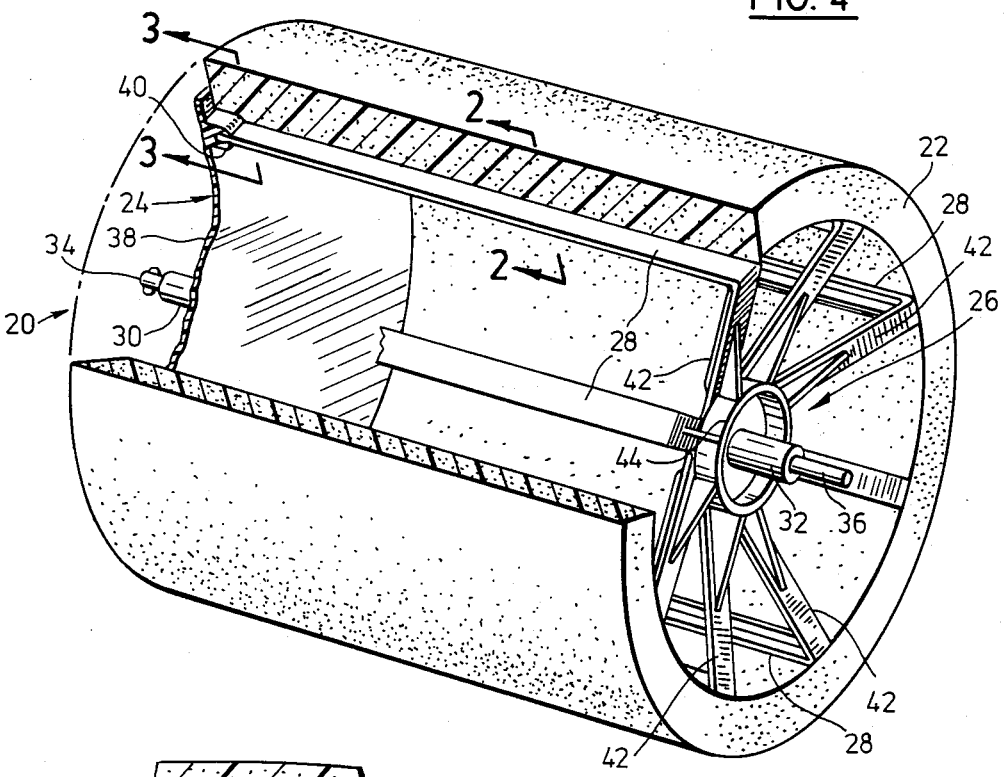
FIG. 1 is a perspective view, partly broken away, and illustrating a first embodiment of an evaporator pad support on which a suitable tubular humidifier pad has been assembled.

Reference is first made to FIG. 1 which illustrates a humidifier pad support designated generally by the numeral 20 and carrying a tubular humidifier pad 22. This embodiment is preferred where it is desired to provide a support having no continuous shaft through the structure.

As seen in FIG. 1, the support includes a fixed end 24, and a movable end 26 connected to the fixed end by eight axially extending stringers 28. The moulded fixed end 24 carries an integral boss 30 extending outwardly and aligned with a boss 32 at the movable end. These bosses carry respectively a drive stub 34 and an idler stub 36 and are fixedly engaged in the respective bosses 30, 32. The stubs 34, 36 are aligned about the axis of rotation of the generally cylindrical support 20.

The fixed end 24 also includes an end wall 38 from which the boss 30 is dependent, and which carries integrally formed sockets 40 projecting inwardly to receive ends of the respective stringers 28 as will be described with reference to FIGS. 3 and 4. These sockets are spaced equally from one another on a circle centred at the axis of rotation.

The stringers 28 are integrally moulded with radial spokes 42 and with a central hub 44 from which the boss 32 is also dependent. As will be described, the spokes 42 are connected to the hub by inner living hinges and at their other ends, they are connected to the stringers 28 by outer living hinges.

Figure 3:
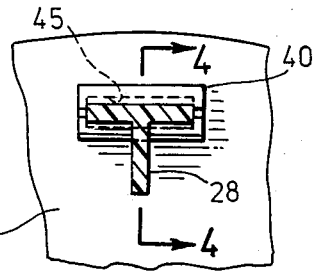
FIG. 3 is a view similar to FIG. 2 on line 3—3 of FIG. 1.
Figure 4:
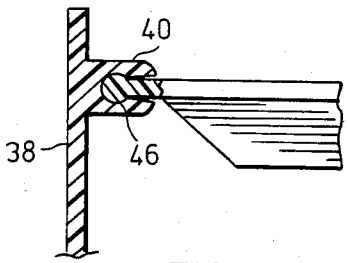
FIG. 4 is a sectional view on line 4—4 of FIG. 3.
Figure 2:
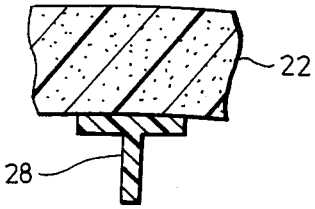
FIG. 2 is a sectional view of a part of the support and pad on line 2—2 of FIG. 1.

As seen in FIG. 2, each of the stringers 28 has a generally T-shaped cross-section for enhanced rigidity and at the ends, they are formed to engage in the sockets 40 (FIG. 1) as better seen in FIGS. 3 and 4. These sockets have central cavity 45 proportioned to receive a bead 46 on the end of a stringer 28 and the sockets are relieved both at their ends (FIG. 3) and at their mouths (FIG. 4) so that the material of the socket will deflect as the bead is engaged in the socket. Also, the slight relief at the mouth provides for a slight movement of the stringer in a radial direction relative to the socket for purposes which will be explained. However, it is important to note that the extent of the bead 46 is such that the assembly of the fixed end 24 with the stringers is rigid torsionally.

The movable end 26 will now be described in more detail with reference to FIG. 5 which also illustrates the operation of the support when removing an old pad and engaging a new one.

As mentioned previously, the spokes 42 are moulded integrally formed with the stringers 28 and meet the stringers at living hinges to permit angular movement between the spokes and the stringers. However, the angular movement is limited because the T-shape of the stringers is matched by a similar cross-section of the spokes 42. Consequently, in the position shown in full outline in FIG. 5, the spokes cannot move inwardly further than the position shown due to the engagement of the shoulders formed at the adjacent ends of the webs of the T-shaped sections of the spokes and stringers. This engagement resists the compressive force applied by slight hoop stress in the pad after it is positioned on the support as will be described. The tendency to collapse is also resisted at the living hinges between the spokes 42 and the hub 44. In this instance, outer ribs 48 are formed on the spokes to provide shoulders for abutment with a shoulder formed by a cylindrical wall 50 at the outer periphery of the hub. It will be appreciated, that any force applied radially to the stringers at the movable end 26 will be transmitted by the axially inclined spokes and tend to force the hub axially towards the fixed end 24. This tendency is resisted by the engagement of the shoulders at the inner and outer living hinges. Consequently, with the suport in the position shown in full outline in FIG. 5, the humidifier pad 22 is carried by the support ready to be placed in a humidifier housing with the lower part of the pad engaged in a water reservoir.

Figure 5:
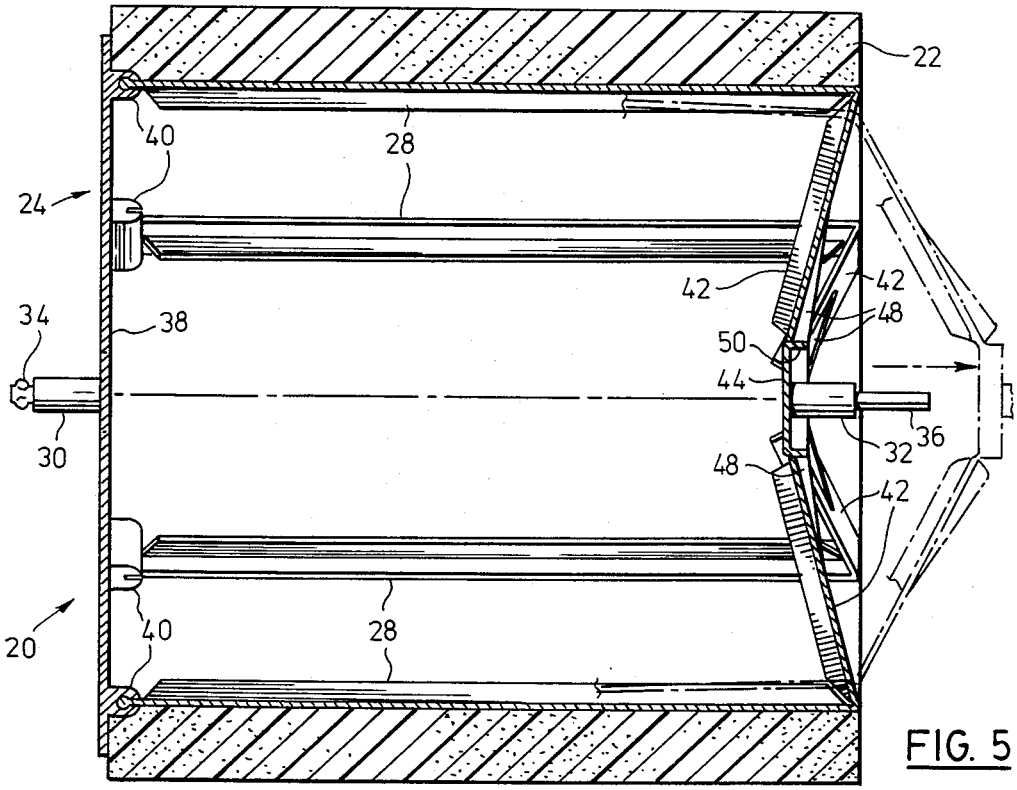
FIG. 5 is a transverse sectional view of the support and pad shown in FIG. 1 and illustrating how the support is manipulated to place a pad on, and to remove a pad from the support.

FIG. 5 also shows in ghost outline the position of the movable end 26 after the support has been collapsed to facilitate replacement of the pad. Because of the arrangement of living hinges, it is possible to grasp the boss 32 and to pull the boss and hub 44 axially outwards against the inward bias caused by the loop stress in the pad 22. This over-center action is continued until the position shown in ghost outline is reached. In this collasped condition, the stringers 28 have deflected inwardly, particularly at the ends adjacent the movable end 26. There is then no residual stress in the pad adjacent the movable end and the pad resumes or maintains its normal size which defines an internal diameter larger than the collapsed size of the movable end. Consequently the pad can be withdrawn quite readily over the movable end and a new pad placed on the support. Because of the collapsed shape of the support, the pad can be readily slipped onto the stringers and guided by the stringers until it is engaged against the fixed end wall 38. The hub 44 is then pumped axially back into the position shown in solid outline.

Figure 6:
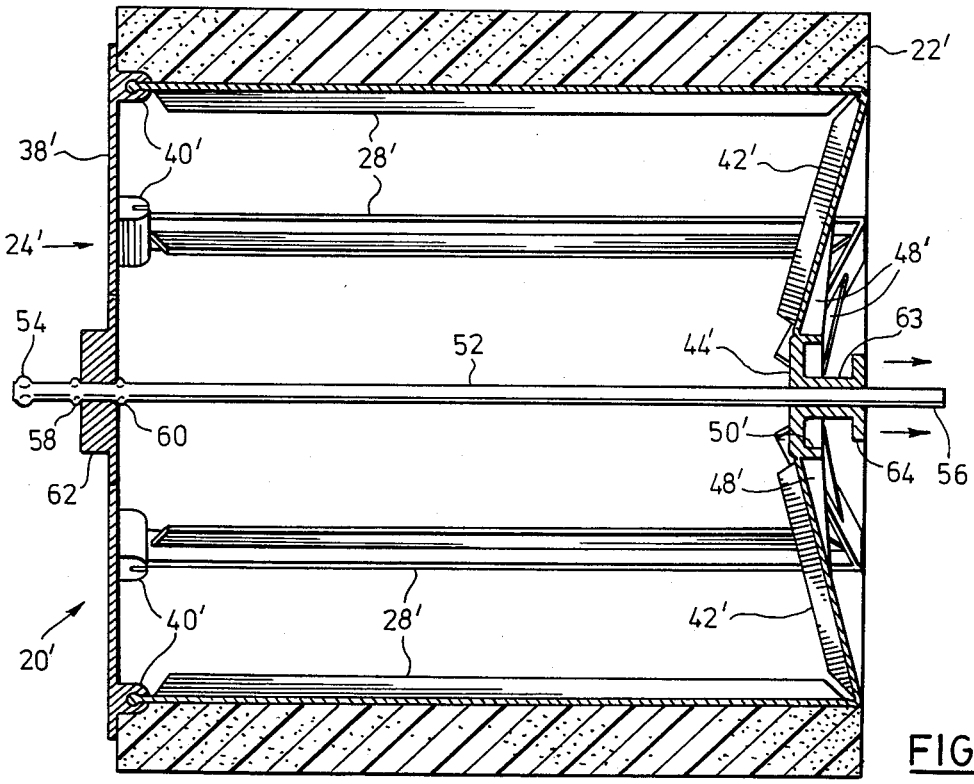
FIG. 6 is a view similar to FIG. 5 and showing a second embodiment of the support.

As mentioned earlier, the embodiment shown on FIGS. 1 to 5 is to be preferred when a structure requiring no continuous axle is desired. However, the structure shown in these figures can be modified quite readily to operate on an axle as shown in FIG. 6. Although the structure shown in FIG. 6 is not the preferred structure when an axle is used, it nevertheless serves to illustrate how the major elements of the structure shown in FIG. 5 can be accommodated on an axle. In FIG. 6, parts corresponding to those already described with reference to FIGS. 1 to 5 are referenced by primed numerals.

In place of the bosses 30, 32 and stubs 34 and 36 shown in FIG. 5, the embodiment shown in FIG. 6 uses an axle 52 having a drive end 54 and an idler end 56. Adjacent to drive end 54, the axle defines two pairs of small lugs 58, 60 spaced apart and in engagement with a boss 62 formed integrally with the wall 38'. The axle 52 is locked to the fixed end 24' by forcing the axle through the boss 62 into the position shown. At its other end, the axle guides hub 44' to which is attached a boss 62 and flange 64 to permit gripping this part to pull it axially as it is guided by the axle 52. It will be evident that the operation of the structure shown in FIG. 6 is very similar to that shown in FIG. 5 with the exception that the hub 44' is guided as it slides on the axle 52 and does not depend entirely for its location on its connection to the spokes.

Figure 7:
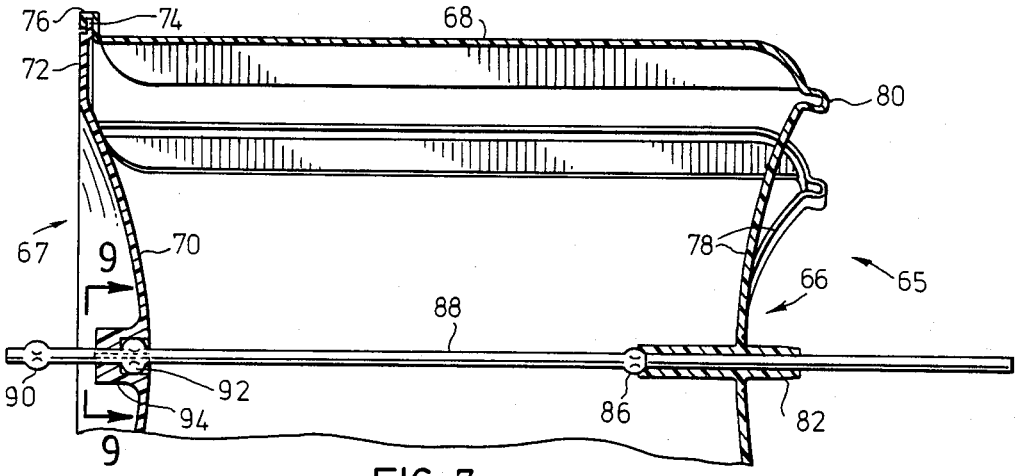
FIG. 7 is a partial sectional view similar to FIG. 5 and illustrating a third embodiment of the support in position to carry a pad.

Reference is next made to FIG. 7 which is a view similar to FIG. 5 and illustrating a preferred embodiment of pad support when an axle is used. Because the axle provides better support for the movable end, this embodiment is to be preferred in most installations.

As seen in FIG. 7, a support 62 is provided having a fixed end 64 and a movable end 66. As in previous embodiments, these ends are connected to one another by stringers 68 having a generally T-shaped cross-section. However in this embodiment, the fixed end 64 consists of a dished wall 70 terminating in a radial portion 72 which in turn, has a short peripheral lip 74. This lip is engaged in an internal groove formed in a ring 76 which is an integral part of the stringers 68 and which serves both to attach the stringers to the fixed end 64 and to maintain the stringers in spaced relationship. The width of the stringers is such that the connection to the ring ensures torsional rigidity. At their other ends, the stringers 68 are coupled to flexible strap-like spokes 78 by U-shaped portions 80 which are effectively extensions of the spokes formed to provide a portion of reduced cross section which will permit angular movement between the spokes and stringers. Further, because of the strap-like shape of the spokes, they are capable of deflection into a curved position shown in FIG. 7, and they are of course retained in this position by the development of hoop stress in the pad which is normally carried on the support as shown in other Figs. There is therefore a somewhat similar over-center effect as there was in the previous embodiments which employed rigid spokes and living hinges.

Figure 8:
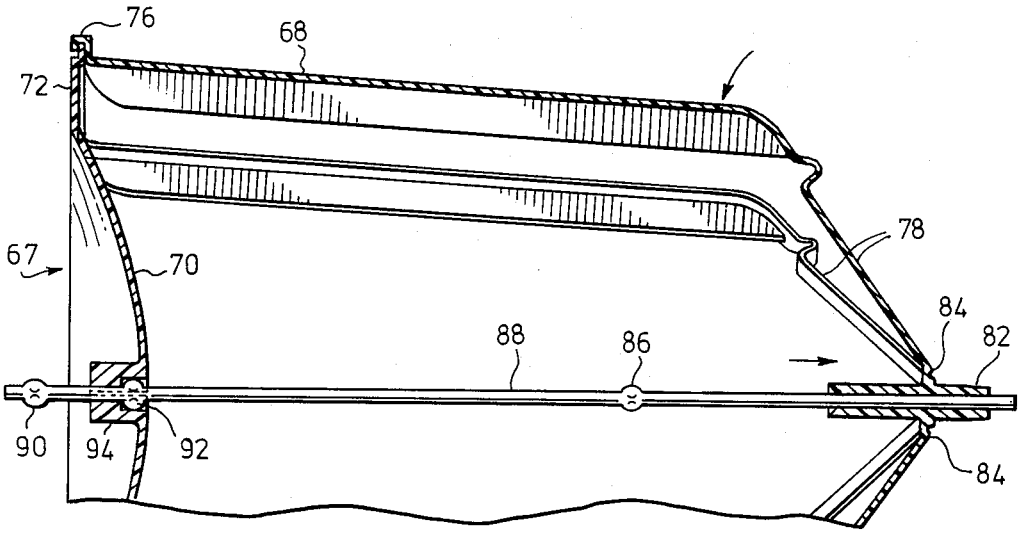
FIG. 8 is a view similar to FIG. 7 and showing the third embodiment in position to receive a humidifier pad.
Figure 9:
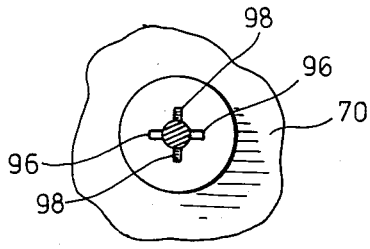
FIG. 9 is a sectional view on line 9—9 of FIG. 7.

The inner ends of the spokes are formed integrally about an elongated hub 82 and connected by living hinges 84 seen better in FIG. 8. These hinges are unlike those previously described because they are not used to locate the hub axially. The hub is prevented from moving inwardly beyond the FIG. 7 position by lugs 86 formed on an axle 88 on which the hub 82 can move outwardly into the position shown in FIG. 8 as was described. The axle also defines a drive end 90 and a further pair of lugs 92 which are a force fit in a hub 94 formed integrally on the outer surface of the wall 70. This hub 94 must provide clearance to pass the lugs 86 and 92 through the hub to permit assembly of the axle on the fixed end 64. As seen in FIG. 9, the hub 94 defines a pair of slots 96 (also seen in FIG. 7 in broken outline) and these slots provide clearance to enter the lugs 86 and 92. After the lugs 92 are pushed through the hub, the axle is rotated through 90 degrees and drawn back to engage these lugs in smaller recesses 98 which are proportioned to provide a force fit for the lugs. Obviously this force fit must be sufficient to prevent separation during normal use although the over-centre action at the movable end causes hub 82 to engage the axle and tend to hold the lugs.

Turning now to FIG. 8, it will be seen in this figure that movement of the hub 82 outwardly along the axle 88 has resulted in collapsing the movable end 62 of the support facilitated both by the living hinges 84 and by the u-shaped portion 80 adjacent outer ends of the spokes 78. It should also be noticed that the spokes are now straight and that in the FIG. 7 position the curved spokes are retaining stored energy helping to maintain the pad in a slightly stressed condition to prevent it separating from the support and to provide the force needed to retain the hub 82 in the assembled position shown in FIG. 7. This also helps to maintain rigidity in the support to withstand the load in the pad when it is wet and carrying water from the reservoir in which it normally runs. Although not shown an alternative form of construction would eliminate the hinge 84 and rely only on the flexibility of the spokes 78.

The embodiment shown in FIGS. 7 to 9 has a number of advantages in manufacture. The U-shaped portions at the ends of the spokes permit ready flow of molten plastic during moulding so that the structure can be injection moulded at the ring 76. Similar moulding techniques can be used in the embodiment shown in FIGS. 5 and 6 but it will be appreciated that the living hinges at the outer ends of the spokes will cause a restriction to the moulding material and greater pressures and longer moulding cycles will be required to ensure that the molten material flows completely to the hub 44. The embodiment shown in FIGS. 7 to 9 is therefore preferable to the standpoint of manufacture as well as use. However it can be modified by, for instance, making the spokes 78 rigid, or near rigid, in which case the structure is spring-loaded by way of the elastic nature of the pad, and/or the 'U'-shaped portion.

It will be appreciated that various other embodiments can be made within the scope of the invention as described and claimed and the individual shapes and cross-sections of parts can be changed without departing from the scope of the invention.

We claim:

1. In a support for a tubular humidifier pad having first and second ends and stringers extending axially between the ends to support the pad, the improvement in which one of the ends comprises a central hub and spokes radiating from the hub, one to each of the stringers, the spokes being connected to the hub and to the stringers to permit angular movement between these parts axially so that movement of the hub from a first position nearer the fixed end in which the spokes are inclined inwardly and towards the fixed end, and in which the stringers are parallel to support the pad, to a second position remote from the fixed end changes the angular relationships between the spokes and the stringers to cause the stringers to deflect inwardly towards the axis thereby facilitating replacement of a pad over said one of the ends before returning the movable end to said first position to support the new pad.

2. A support for a tubular humidifier pad of the type used in a humidifier receiving air from a forced-air furnace, the support being generally cylindrical about a longitudinal axis and comprising:

a transverse fixed end;

a transverse movable end comprising a central hub and a plurality of spokes extending generally radially, each of the spokes being attached to the hub for movement angularly in an axial direction relative to the hub;

a plurality of stringers extending axially between the fixed and movable ends, the stringers being coupled one to each of the spokes for angular movement axially between the stringers and the spokes, and to the fixed end;

the hub being located in a first position nearer the fixed end when supporting the pad on the stringers with the stringers parallel and the spokes inclined inwardly towards the fixed end, the pad exerting a slight radial force to maintain the spokes in position, the hub being manually movable axially away from the fixed end to a second position to thereby move the spokes and stringers angularly relative to one another, the stringers then being deflected radially inwards to collapse the support so that the diameter of the support is then reduced at the movable end for ready replacement of the pad axially over the movable end of the support;

means coupled to the fixed and moveable ends to suspend the support in the humidifier for rotation about its axis in use; and means limiting the movement of the hub towards the fixed end to locate the hub in said first position in use.

3. A support as claimed in claim 2 in which the hub is attached to the spokes at living hinges.

4. A support as claimed in claim 2 in which the spokes are attached to the stringers at living hinges.

5. A support as claimed in claim 2 in which the limiting means comprises shoulders defined by the stringers and spokes at adjacent ends of the spokes and stringers for engagement with one another when the support is in said first position.

6. A support as claimed in claim 2 in which the limiting means comprises shoulders defined by the spokes and hub for engagement with one another with the support in said first position.

7. A support as claimed in claim 2 in which the means for suspending the support is an axle passing through the fixed and movable ends and in which the limiting means is defined on the axle for engagement by the hub to prevent excessive movement towards the fixed end.

8. A support as claimed in claim 2 in which the spokes are flexed to exert an outward radial force with the support in the first position.

9. The combination of a humidifier support as claimed in claim 1 and an annular humidifier pad engaged snugly over the stringers with the movable end in said first position so that the combination is ready for use in a humidifier.

* * * * *